US007360379B1

(12) United States Patent
Lopez

(10) Patent No.: US 7,360,379 B1
(45) Date of Patent: Apr. 22, 2008

(54) LAPTOP COMPUTER SECURING SYSTEM

(76) Inventor: Mario A. Lopez, 1232 N. Park Western Dr., Apartment #3, San Pedro, CA (US) 90732

( * ) Notice: Subject to any disclaimer, the term of this patent is extended or adjusted under 35 U.S.C. 154(b) by 0 days.

(21) Appl. No.: 11/620,506

(22) Filed: Jan. 5, 2007

(51) Int. Cl.
*E05B 73/00* (2006.01)

(52) U.S. Cl. ..... 70/58; 70/69; 206/320

(58) Field of Classification Search ..... 70/58, 70/14, 30, 49, 63–76; 190/100–102, 110; 150/100–102; 206/1.5, 320
See application file for complete search history.

(56) References Cited

U.S. PATENT DOCUMENTS

| | | | | |
|---|---|---|---|---|
| 5,031,641 | A * | 7/1991 | Upton | 128/879 |
| 5,140,833 | A * | 8/1992 | Whalen | 62/457.7 |
| 5,195,634 | A * | 3/1993 | Zaug | 206/320 |
| 5,390,787 | A * | 2/1995 | Macasaet | 206/309 |
| 5,595,073 | A * | 1/1997 | Sullivan | 70/18 |
| 5,762,170 | A * | 6/1998 | Shyr et al. | 190/109 |
| 5,794,463 | A * | 8/1998 | McDaid | 70/18 |
| 6,026,662 | A | 2/2000 | Schlipper | |
| 6,112,562 | A | 9/2000 | Murray, Jr. et al. | |
| 6,155,715 | A * | 12/2000 | Lake et al. | 383/6 |
| 6,216,499 | B1 | 4/2001 | Ronberg et al. | |
| 6,295,847 | B1 * | 10/2001 | Zeren | 70/58 |
| 6,389,853 | B1 | 5/2002 | Pate et al. | |
| 6,477,870 | B1 | 11/2002 | Derman | |
| 6,513,350 | B1 * | 2/2003 | Hurd et al. | 70/58 |
| 6,530,475 | B1 * | 3/2003 | Penney | 206/320 |
| 6,547,436 | B2 * | 4/2003 | Sutton | 383/18 |
| 6,622,532 | B2 | 9/2003 | Hsu | |
| 6,705,133 | B1 | 3/2004 | Avganim | |
| 6,726,071 | B2 * | 4/2004 | Baseflug et al. | 224/258 |
| 6,973,809 | B2 | 12/2005 | Chang | |
| 2002/0148395 | A1 * | 10/2002 | Judge | 109/52 |
| 2003/0000857 | A1 * | 1/2003 | Jones | 206/320 |
| 2003/0052786 | A1 * | 3/2003 | Dickinson | 340/572.8 |
| 2003/0110818 | A1 | 6/2003 | Schlipper | |
| 2003/0178332 | A1 * | 9/2003 | Lindamood | 206/320 |
| 2004/0003975 | A1 * | 1/2004 | Dulin | 190/110 |
| 2005/0121121 | A1 * | 6/2005 | Wang | 150/117 |
| 2006/0027002 | A1 * | 2/2006 | Cheng | 70/58 |

FOREIGN PATENT DOCUMENTS

| | | |
|---|---|---|
| DE | 469332 | 12/1928 |

* cited by examiner

*Primary Examiner*—Lloyd A. Gall

(57) ABSTRACT

A laptop computer securing system includes a luggage case that has a bottom wall and a peripheral wall that is attached to and extends upwardly from the bottom wall. The peripheral wall has an upper edge defining an opening into the luggage case. A cover is pivotally coupled to the upper edge and is selectively positionable in a closed position extending over and closing the opening. A closure is attached to the cover to selectively secure the cover in the closed position. A cable has a first end and a second end. The cable is attached to the peripheral wall. The cable extends into the luggage case from the peripheral wall. A locking assembly is attached to the second end of the cable and is configured to be extended into and releasably locked to a laptop computer.

10 Claims, 2 Drawing Sheets

LAPTOP COMPUTER SECURING SYSTEM

BACKGROUND OF THE INVENTION

1. Field of the Invention

The present invention relates to laptop computer securing devices and more particularly pertains to a new laptop computer securing device for securing a laptop computer to a person's luggage in such a manner that airport security personnel may still easily inspect the laptop computer.

2. Description of the Prior Art

The use of laptop computer securing devices is known in the prior art. While these devices fulfill their respective, particular objectives and requirements, the need remains for a system that allows a person to effectively lock or secure a laptop computer to their luggage while still allowing access to the laptop computer to security personnel of an airport. This will ensure that the laptop cannot be easily stolen from luggage or during the screening process, while complying with government rules requiring security personnel access to electronic devices.

SUMMARY OF THE INVENTION

The present invention meets the needs presented above by generally comprising a luggage case that has a bottom wall and a peripheral wall that is attached to and extends upwardly from the bottom wall. The peripheral wall has an upper edge defining an opening into the luggage case. A cover is pivotally coupled to the upper edge and is selectively positionable in a closed position extending over and closing the opening. A closure is attached to the cover to selectively secure the cover in the closed position. A cable has a first end and a second end. The cable is attached to the peripheral wall. The cable extends into the luggage case from the peripheral wall. A locking assembly is attached to the second end of the cable and is configured to be extended into and releasably locked to a laptop computer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
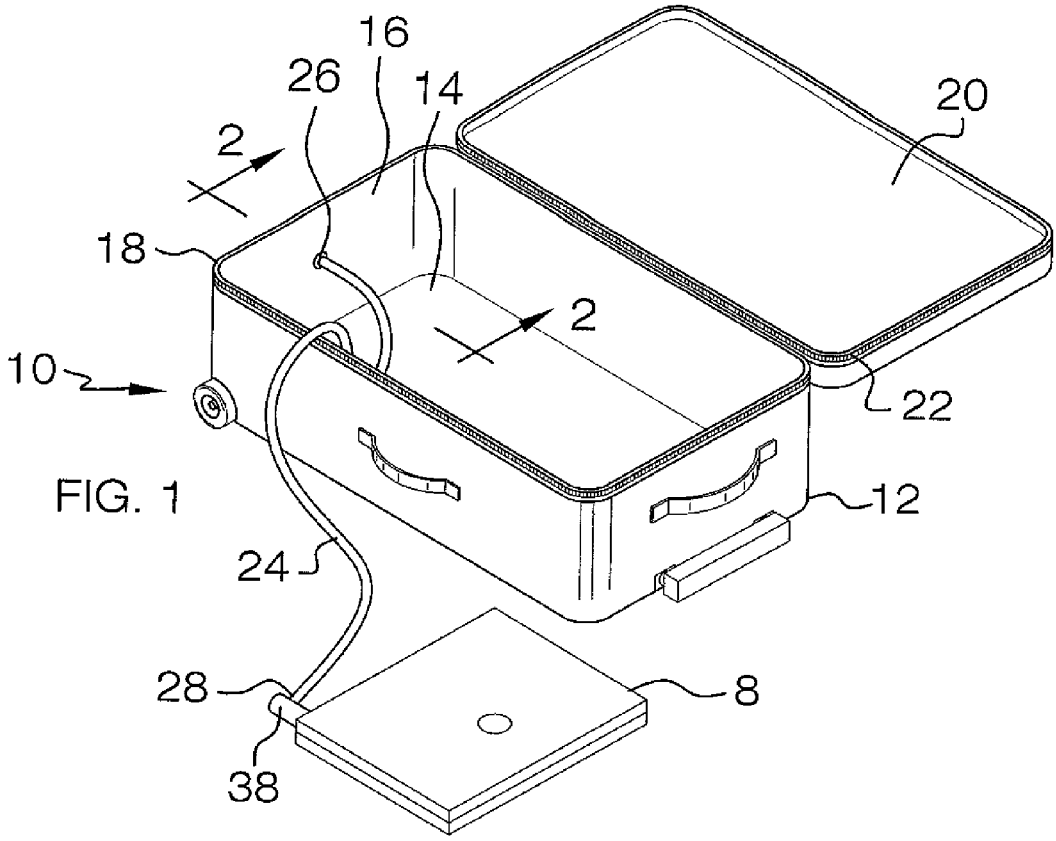
FIG. 1 is a perspective view of a laptop computer securing system according to the present invention.
Figure 2:
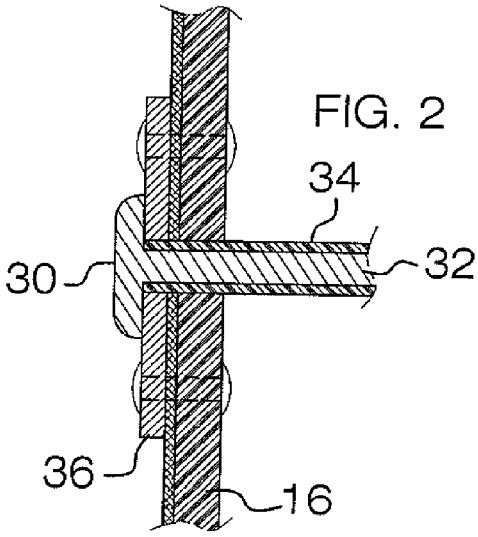
FIG. 2 is a cross-sectional view taken along line 2-2 of FIG. 1 of the present invention.
Figure 3:
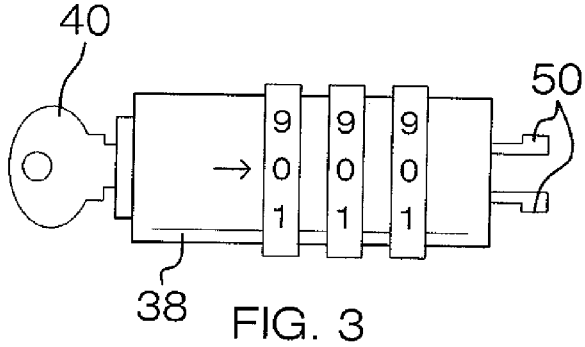
FIG. 3 is a side view of a locking assembly of the present invention.
Figure 4:
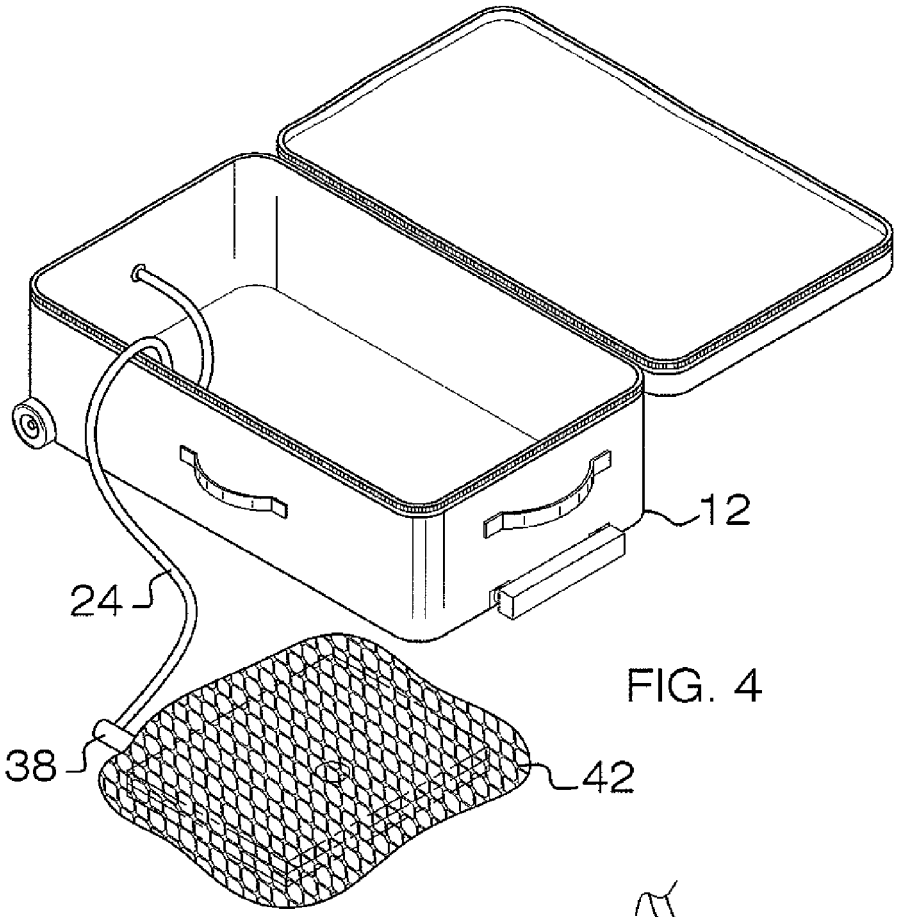
FIG. 4 is a perspective view of the present invention.

With reference now to the drawings, and in particular to FIGS. 1 through 5 thereof, a new laptop computer securing device embodying the principles and concepts of the present invention and generally designated by the reference numeral 10 will be described.

As best illustrated in FIGS. 1 through 5, the laptop computer 8 securing system 10 generally comprises a luggage case 12 that has a bottom wall 14 and a peripheral wall 16 that is attached to and extends upwardly from the bottom wall 14. The peripheral wall 16 has an upper edge 18 that defines an opening into the luggage case 12. A cover 20 is pivotally coupled to the upper edge 18 and is selectively positionable in a closed position extending over and closing the opening. A closure 22, such as a zipper, is attached to the cover 20 to selectively secure the cover 20 in the closed position. The luggage case 12 is at least large enough to hold the laptop computer 8 and is preferably large enough to hold a plurality of clothing items in addition to the laptop computer 8.

A cable 24 has a first end 26 and a second end 28. The cable 24 is attached to the peripheral wall 16 and the first end 26 is positioned adjacent to the peripheral wall 16. The cable 24 extends into the luggage case 12 from the peripheral wall 16 and a head 30 is attached to the first end 26 of the cable 24. The head 30 is positioned outside of the luggage case 12 and prevents the first end 26 from being pulled through the peripheral wall 16. The cable 24 includes an inner core 32 and an outer sheath 34. The inner core 32 comprises a flexible metallic cord and the outer sheath 34 comprises an elastomeric material.

A plate 36 is attached to an outer surface of the peripheral wall 16. The cable 24 extends through the plate 36 and the head 30 abuts the plate 36. The plate 36 is comprised of a metallic material to inhibit the cable 24 and the head 30 from being pulled through and away from the peripheral wall 16.

A locking assembly 38 is attached to the second end 28 of the cable 24. The locking assembly 38 is configured to be extended into and releasably locked to the laptop computer 8. The locking assembly 38 comprises a combination lock that may include a key 40 for overriding the combination mechanism.

Figure 5:
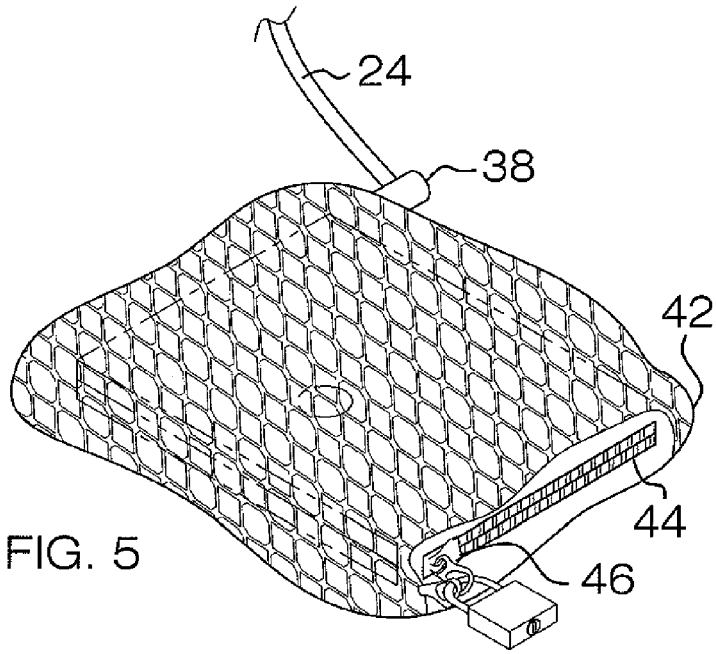
FIG. 5 is a perspective view of the present invention.

A mesh sack 42 may be provided that is comprised of a metallic material that has an aperture 44 therein. The laptop computer 8 is positioned in the sack 42 through the aperture. A locking member 46 is configured to selectively lock the aperture 44 in a closed configuration. The locking member 46 may include a zipper and lock combination as shown in FIG. 5. The locking assembly 38 extends through the mesh of sack 42.

In use, the luggage case 12 is used in a conventional manner for holding a laptop computer 8, work product, and personal items such as clothing. The locking assembly 38 includes prongs 50 that are extended into the laptop computer 8 and are attached to a conventional lock receiver, not shown, on a laptop computer 8. These lock receivers are conventional for allowing a person to attach a laptop computer 8 to a workstation to prevent theft of the computer. For those laptop computers 8 which do not come equipped with a lock receiver, a lock receiver that mates with the lock assembly 38 may be attached to the laptop computer 8. The mesh sack 42 may be used to prevent the opening of the laptop computer 8. The cable 24 allows a person to secure their laptop computer 8 within the luggage case 12 while allowing access to the laptop 8 to security personnel of an airport.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A laptop computer securing system configured to be extended into and secured to a laptop computer, said system comprising:

a luggage case having a bottom wall and a peripheral wall being attached to and extending upwardly from said bottom wall, said peripheral wall having an upper edge defining an opening into said luggage case, a cover being pivotally coupled to said upper edge and being selectively positionable in a closed position extending over and closing said opening, a closure being attached to said cover to selectively secure said cover in said closed position;

a cable having a first end and a second end, said cable being attached to said peripheral wall and said first end being positioned adjacent to said peripheral wall, said cable extending into said luggage case from said peripheral wall, said first end of said cable being positioned outside of said luggage case and said second end of said cable being positionable within said luggage case; and a locking assembly being attached to said second end of said cable, said locking assembly being extended into and releasably locked to the laptop computer, said second end of said cable being removably positionable within said luggage case with the laptop computer.

2. The system according to claim 1, further including a head being attached to said first end of said cable, said head being positioned outside of said luggage case.

3. The system according to claim 1, wherein said cable includes an inner core and an outer sheath, said inner core comprising a flexible metallic cord.

4. The system according to claim 3, wherein said outer sheath comprises an elastomeric material.

5. The system according to claim 2, further including a plate being attached to an outer surface of said peripheral wall, said cable extending through said plate and said head abutting said plate.

6. The system according to claim 5, wherein said plate is comprised of a metallic material to inhibit said cable from being pulled away from said peripheral wall.

7. The system according to claim 1, wherein said locking assembly comprises a combination lock.

8. The system according to claim 1, further including a mesh sack comprised of a metallic material having an aperture therein for receiving the laptop computer into said sack, a locking member being configured to selectively lock said aperture in a closed configuration, said locking assembly extending through said sack.

9. A laptop computer securing system configured to be extended into and secured to a laptop computer, said system comprising:

a luggage case having a bottom wall and a peripheral wall being attached to and extending upwardly from said bottom wall, said peripheral wall having an upper edge defining an opening into said luggage case, a cover being pivotally coupled to said upper edge and being selectively positionable in a closed position extending over and closing said opening, a closure being attached to said cover to selectively secure said cover in said closed position;

a cable having a first end and a second end, said cable being attached to said peripheral wall and said first end being positioned adjacent to said peripheral wall, said cable extending into said luggage case from said peripheral wall, a head being attached to said first end of said cable, said head being positioned outside of said luggage case, said cable including an inner core and an outer sheath, said inner core comprising a flexible metallic cord, said outer sheath comprising an elastomeric material;

a plate being attached to an outer surface of said peripheral wall, said cable extending through said plate and said head abutting said plate, said plate being comprised of a metallic material to inhibit said cable from being pulled away from said peripheral wall; and a locking assembly being attached to said second end of said cable, said locking assembly being configured to be extended into and releasably locked to the laptop computer, said locking assembly comprising a combination lock.

10. The system according to claim 9, further including a mesh sack comprised of a metallic material having an aperture therein for receiving the laptop computer into said sack, a locking member being configured to selectively lock said aperture in a closed configuration, said locking assembly extending through said sack.

* * * * *